US007228273B2

(12) United States Patent
Okunoki

(10) Patent No.: US 7,228,273 B2
(45) Date of Patent: Jun. 5, 2007

(54) VOICE CONTROL METHOD

(75) Inventor: Yutaka Okunoki, Ohta-ku (JP)

(73) Assignee: Sega Corporation, Tokyo (JP)

( * ) Notice: Subject to any disclaimer, the term of this patent is extended or adjusted under 35 U.S.C. 154(b) by 827 days.

(21) Appl. No.: 10/291,710

(22) Filed: Nov. 12, 2002

(65) Prior Publication Data

US 2003/0115063 A1 Jun. 19, 2003

(30) Foreign Application Priority Data

Dec. 14, 2001 (JP) ..... 2001-381950

(51) Int. Cl.
*G10L 19/14* (2006.01)
*G10L 21/00* (2006.01)

(52) U.S. Cl. ..... 704/224; 704/268; 704/270

(58) Field of Classification Search ..... None
See application file for complete search history.

(56) References Cited

U.S. PATENT DOCUMENTS

| | | | | |
|---|---|---|---|---|
| 5,327,521 | A * | 7/1994 | Savic et al. | 704/272 |
| 6,169,555 | B1 * | 1/2001 | Yamamoto | 345/473 |
| 6,336,092 | B1 * | 1/2002 | Gibson et al. | 704/268 |
| 6,463,412 | B1 * | 10/2002 | Baumgartner et al. | 704/246 |
| 6,577,998 | B1 * | 6/2003 | Yamamoto | 704/270 |
| 6,987,514 | B1 * | 1/2006 | Beresin et al. | 345/473 |
| 2002/0111794 | A1 * | 8/2002 | Yamamoto et al. | 704/200 |
| 2002/0161882 | A1 * | 10/2002 | Chatani | 709/224 |
| 2003/0025726 | A1 * | 2/2003 | Yamamoto | 345/723 |

FOREIGN PATENT DOCUMENTS

| | | |
|---|---|---|
| JP | 7-104792 | 4/1995 |
| JP | 08-190518 | 7/1996 |
| JP | 08-318051 | 12/1996 |
| JP | 10-133852 | 5/1998 |
| JP | 2001-34280 | 2/2001 |
| JP | 2001-314657 | 11/2001 |
| JP | 2003141564 | * 5/2003 |

OTHER PUBLICATIONS

IEICE Technical Report, vol. 99 No. 448, p. 47-52, Nov. 18, 1999.
IEICE Technical Report, vol. 99 No. 721, Takano et al., pp. 21-27.

* cited by examiner

*Primary Examiner*—Tālivaldis Ivars Šmits
*Assistant Examiner*—Eunice Ng
(74) *Attorney, Agent, or Firm*—Dickstein Shapiro LLP

(57) ABSTRACT

A voice control method that allows vocal characteristics of a character to diversely be set in a computer game where characters are capable of voice output is provided. The voice control method comprises, converting a voice that is externally input or provided in advance, based upon attribute information on the character; and an output step for outputting the converted voice as voice of the character. According to this method, the voice produced by a character that appears in a computer game can be set in accordance with the character's characteristics and various voices for each character set by each player can be created.

23 Claims, 8 Drawing Sheets

VOICE CONTROL METHOD

BACKGROUND OF THE INVENTION

1. Field of the Invention

The present invention relates generally to a voice control method for controlling the voice produced by a character that appears in a computer game, and more particularly, to a voice control method for changing the vocal characteristics of the voice of a character depending on attributes of the character.

2. Description of the Related Arts

Recent progress of communications technology has realized a creation of common networks by connecting family game consoles, personal computers, etc., found in homes via, e.g., telephone lines, as well as a creation of common networks by connecting terminal equipment disposed at stores such as game centers and game cafes via optical fibers or other dedicated lines. By way of such networks it has become possible for a plurality of participants to take part in real time in conversations ("chat") and for a plurality of players to take part in a common game.

For example, in games that are executed by a plurality of players via a network (hereinafter referred to as networked games), each player's game console (terminal apparatus) is connected to a server via the network, and by the communication of reciprocal information including information on each player's operation of each console through the server, a shared networked game can progress on each console.

In networked games each player, for example, may be represented by a character, and each player's character may fight with other characters as a combat game, or, for example, the players' characters may take part in an adventure together as a role playing game. In such games there may be a scene where the players can converse with each other using each player's character. Such a conversation may be realized, for example, by text data input by one player via a game console, the text data being sent via the network to the game console of another player and being displayed as a speech balloon in relation to a character on the screen.

FIG. 13 shows an example of such a speech balloon from a computer game screen. As shown in this figure a speech balloon containing the text is displayed next to the character and in this way the players conversation is conducted.

Moreover, due to the increasing capacity seen in the storage medium available to hold program data and the adoption of network-based distribution, it has become possible to handle larger amounts of data. For this reason a trend is developing for characters' speech, that was previously displayed entirely as text or expressed only partially as voice, to be entirely output as a voice.

Network games can be conducted with a greater sense of realism, if the characters are able to converse with each other directly using voice output instead of displaying text data in speech balloons.

When using voice output, a character's vocal characteristics may be set in advance or the player's voice may directly be output. However, setting a character's vocal characteristics in advance results in all players who choose this character having the same voice and thus making for a low level of variety. Likewise, outputting the player's voice unchanged can sometimes result in the voice being inappropriate to the character. For example, if a male player chooses a female character, this female characters ends up conversing in a male voice.

SUMMARY OF THE INVENTION

It is therefore the object of the present invention to provide a voice control method that allows vocal characteristics of a character to diversely be set in a computer game where characters are capable of voice output, and a computer program for the method.

In order to achieve the above object, there is provided a voice control method for controlling a voice produced by a character appearing in a computer game, the method comprising a conversion step for converting a voice that is externally input or provided in advance, based upon attribute information on the character; and an output step for outputting the converted voice as the voice of the character.

Preferably, the conversion step includes changing frequency characteristics of the voice that is externally input or provided in advance, based upon attribute information on the character. The attributes include at least one of, for example, gender, age, height and weight.

According to a first aspect of the present invention, for example, the externally input voice may be a voice produced by a player of the computer game. The conversion step may include finding the amount of variation in frequency characteristics of the voice produced by the player, based upon a relationship between attribute information on the character and the attribute information on the player.

According to a second aspect of the present invention the conversion step may include finding the amount of variation in frequency characteristics of the previously provided voice, based upon a change of attribute information on the character.

In addition, there is provided a computer program allowing a computer apparatus to execute the voice control method of the present invention.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENT

An embodiment of the present invention will be described hereinbelow. It is to be understood that the technical scope of the present invention is not limited to the embodiment.

A voice control method in accordance with the embodiment of the present invention would, for example, be applicable to a game in which a character is configured to produce lines of speech and to a network game which takes place among a plurality of game apparatuses (terminals) via a network, and, for example, could be implemented as one part of a game program that is executed in the game apparatus.

Figure 1:
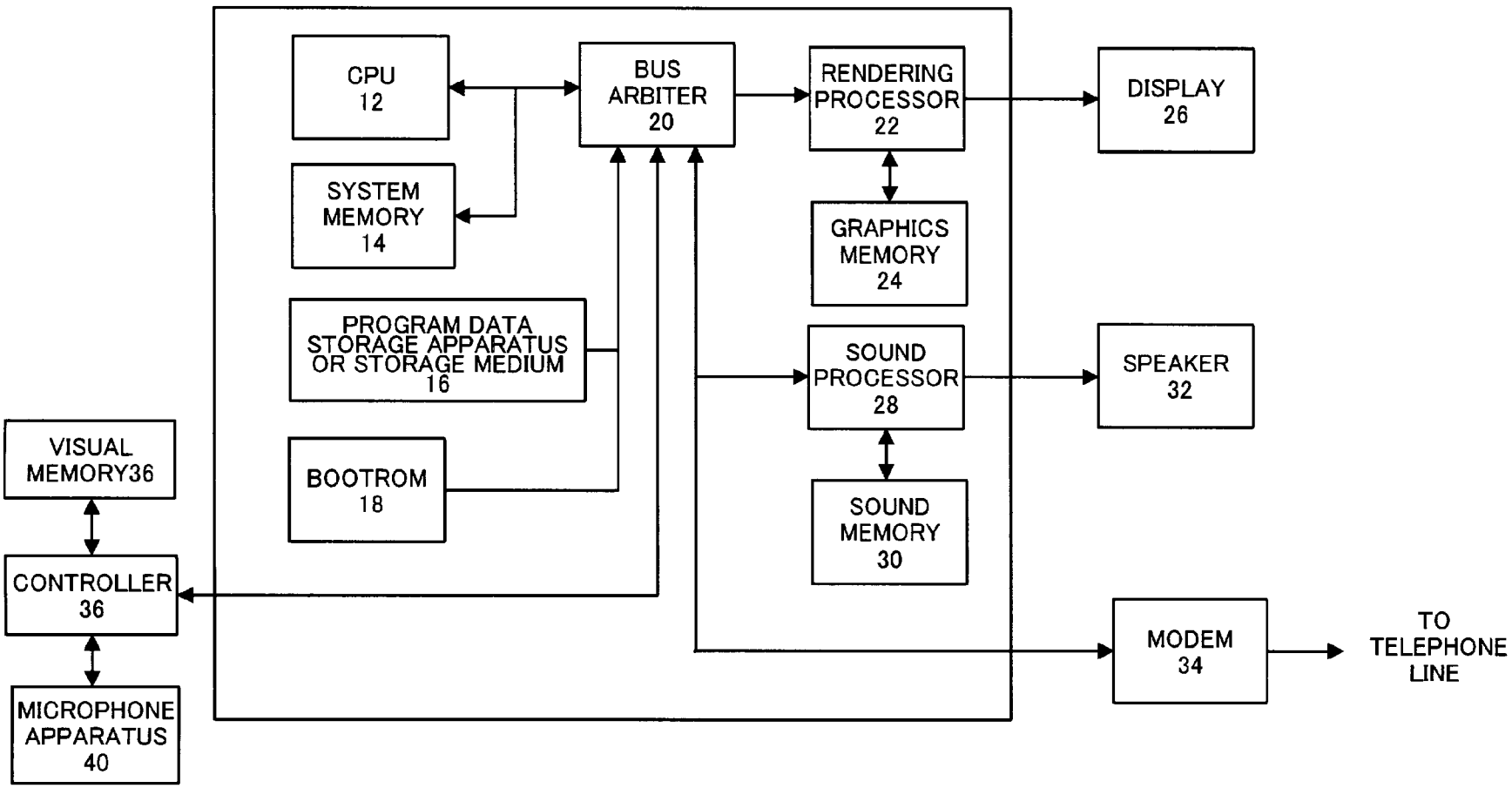
FIG. 1 shows a block diagram of the game apparatus featuring in the embodiment of the present invention.

FIG. 1 is an exemplary block diagram of a game apparatus in accordance with the embodiment of the present invention. As shown in FIG. 1, the game apparatus comprises a CPU 12 which executes the game program and carries out the coordinate computation required for the control of the whole system and image display, and a system memory (RAM) 14 which is used as a buffer memory to hold the program and data required to carry out the processing that CPU 12 conducts, the CPU 12 and the system memory 14 sharing a common connection via a bus line and being connected to a bus arbiter 20. The bus arbiter 20 controls the program and data flow of each block of the game apparatus 10 and all the external devices connected thereto.

In addition, a storage apparatus or storage medium 16 (including optical disks or disk drives that drive specialized games storage medium such as CD-ROMS) which hold the program and data (including audio and visual data) and a BOOT ROM 18 which holds the program and data to boot the game apparatus 10, are connected via the bus line to the bus arbiter 20.

Additionally, a rendering processor 22, which plays back visual data read from the program data storage apparatus or storage medium 16 and creates graphics needed for the graphical display in response to the players' operations and the progression of the game, and a graphics memory 24, which holds, for example, the graphics data required for the rendering processor 22 to carry out image creation, are connected via the bus arbiter 20. The graphics signals output from the rendering processor 22 are converted from digital signals into analogue signals by the video digital analogue converter (DAC) (not shown) and then displayed by a display 26.

In addition, a sound processor 28, which plays back audio data read from the program data storage apparatus or the storage medium 16 and creates sound effects and voice output in response to the players' operations and the progression of the game, and a sound memory 30, which holds, for example, the audio data required for the sound processor 28 to create sound effects and voice output, are connected via the bus arbiter 20. The audio signals output from the sound processor 28 are converted from digital signals into analogue signals by the audio digital analogue converter (DAC) (not shown) and then output from a speaker 32.

Additionally, the bus arbiter 20 has also an interface feature and via a modem 34 is able to be connected to a communication line such as a telephone line. The game apparatus 10 can therefore be connected to the Internet via the telephone line, allowing communications with other game apparatuses or network servers.

In addition, a controller 36, which outputs the information to the game apparatus 10 in order to control the game apparatus 10 and the external devices connected thereto in response to the operations of the player, is connected to the bus arbiter 20.

A visual memory 38, which provides an external means of storage, is connected to a controller 36. The visual memory 38 is provided with an information storage memory for storing various types of information as well as with a sub monitor composed of a liquid crystal display.

In addition, a microphone apparatus 40 which converts the player's voice into electrical signals (voice data) is connected to the controller 36.

The modem 34 is designed for use with an analogue telephone line. However, a terminal adaptor (TA) or router using a telephone line, a cable modem using a cable-television line, a wireless cellular phone or personal handy phone (PHS) using wireless communications means, or optical fiber using optical fiber as a means of communications and other communications methods may equally be used here.

This type of game apparatus can be connected to a server on the network, and by the reciprocal exchange of information related to the game with other game apparatuses that are connected to the server, a plurality of game apparatuses can conduct a network game. The game data exchanged among the game apparatuses can be for example operation data or various setting data of the game apparatus operated by the player, and in this embodiment the voice data produced by the player is also exchanged as the game data.

Figure 2:
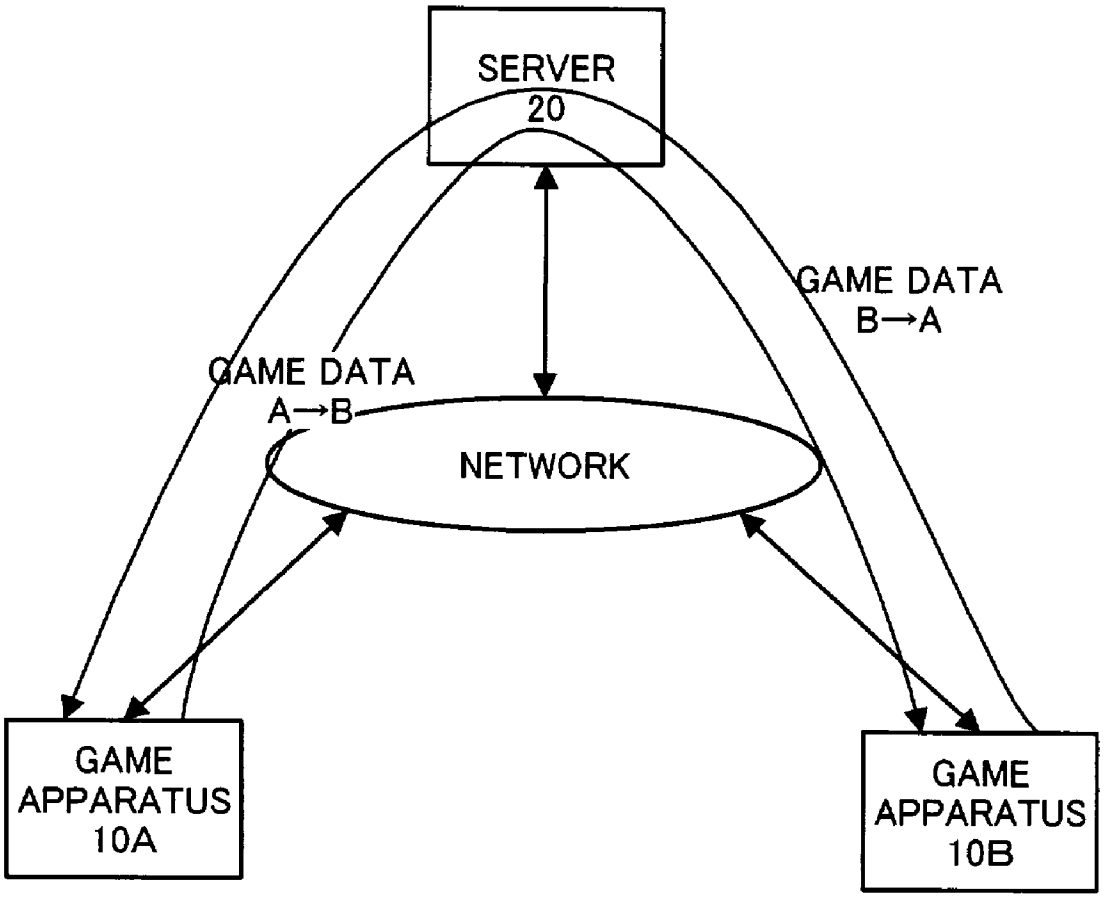
FIG. 2 shows a configuration of a network system including a server and game apparatuses connected thereto.

FIG. 2 shows an exemplary configuration of a network system which includes a server and a plurality of game apparatuses connected thereto. In FIG. 2, a game apparatus 10A operated by a player "a" and a game apparatus 10B operated by a player "b" exchange game data with each other via server 10 which is connected to the network, to execute the network game. The number of game apparatuses that can be connected to the server is not limited to 2. More game apparatuses may be connected. Similarly, the game apparatuses that conduct the network game are not limited to 2 apparatuses. More game apparatuses may take part in the game.

Each game apparatus (10A and 10B) is provided with a microphone which converts the players' voices into voice data. For example, the game apparatus 10A converts the voice data that corresponds to the voice of the player "a", according to the method described below, and the converted voice data is output as words spoken by the character appearing in the network game that represents the player "a" in that character's voice. In addition, the game apparatus 10A sends the converted voice data, as game data, via the server to the game apparatus 10B (which outputs the data onto the network). The game apparatus 10B receives the converted voice data from the game apparatus 10A and as the network game simultaneously progresses, outputs the data as words spoken by the character that represents the player "a" in the voice of that character. In addition, regarding the speech of the player "b", as in the case of the player "a" above, this will be output on a plurality of game apparatuses as the words spoken by the character that represents the player "b" and which appears in the network game that is progressing on a plurality of game apparatuses. In this way, as speech produced by the players is output to give the appearance that the characters are conversing, the game's level of realism is improved.

Subsequently, in this embodiment when the speech of the player is output as words spoken by a character in the network game, as specified above, the player's voice itself is not simply output, but rather the output voice is converted to adapt to characteristics of the character. Below, the voice control method of this embodiment is described in accordance with the processing of a network game's progression.

Figure 3:
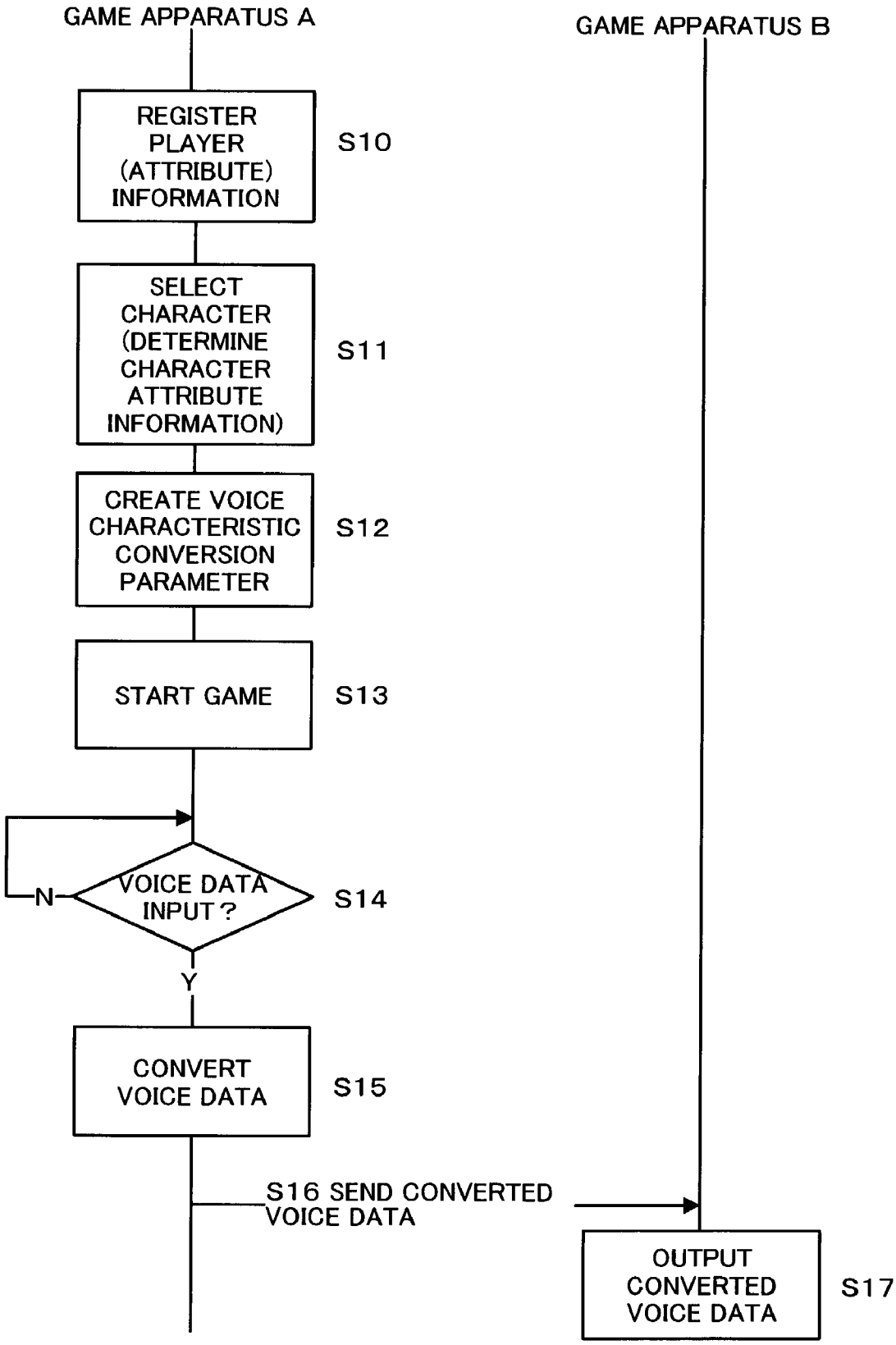
FIG. 3 is a flow chart showing the progression of processing in a network game in accordance with the embodiment of the present invention.

FIG. 3 is a flow chart of the progression processing of the network game in accordance with the embodiment of the present invention. FIG. 3 illustrates the execution of a network game between the game apparatus 10A and the game apparatus 10B, particularly the processing involved in the vocal characteristics conversion of the voice data of the player "a" in the game apparatus 10A.

When the execution of the game program in game apparatus 10A is started, first of all the player "a" player information is registered (S10).

Figure 4:
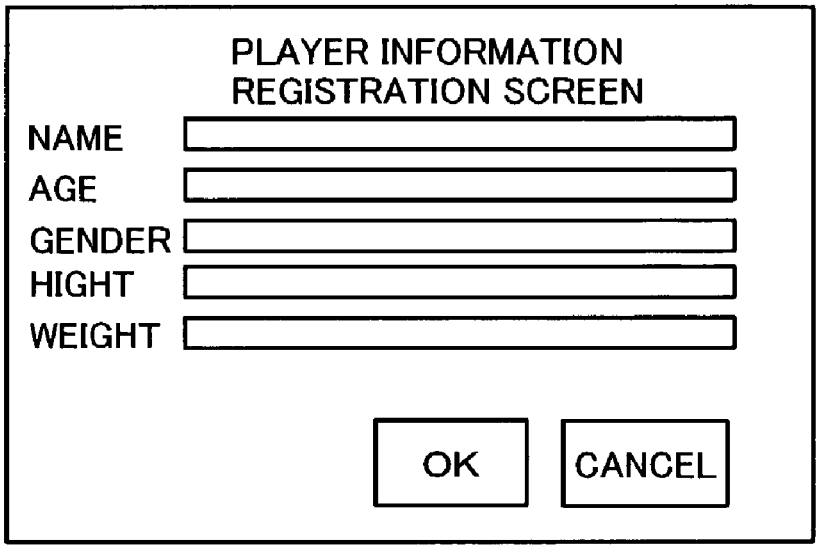
FIG. 4 shows an example of a player registration screen of the game apparatus.

FIG. 4 shows an example of a player's information registration screen from the game apparatus. Player information includes attribute information relating to the player such as the player's name, age, gender and also height and weight etc. When the player "a" inputs his/her player information by operating the game apparatus 10A, as well as being registered in the game apparatus 10A, the player's information is also sent to the server 20 and registered in the server 20. The server 20 uses each player's player information to, for example, group players "a" and "b" (or categorize them) and control the network game between the player "a" game apparatus 10A and the player "b" apparatus 10B. For example, the server 20 may execute the following control: forward game data from game apparatus 10A to the game apparatus 10B, or forward game data from the game apparatus 10B to the game apparatus 10A.

Characters are then selected (S11). Various characters are prepared in advance in the game program and the player chooses a character that he/she likes from among these. Attribute information of the character is determined by the selection of a character.

Figure 5:
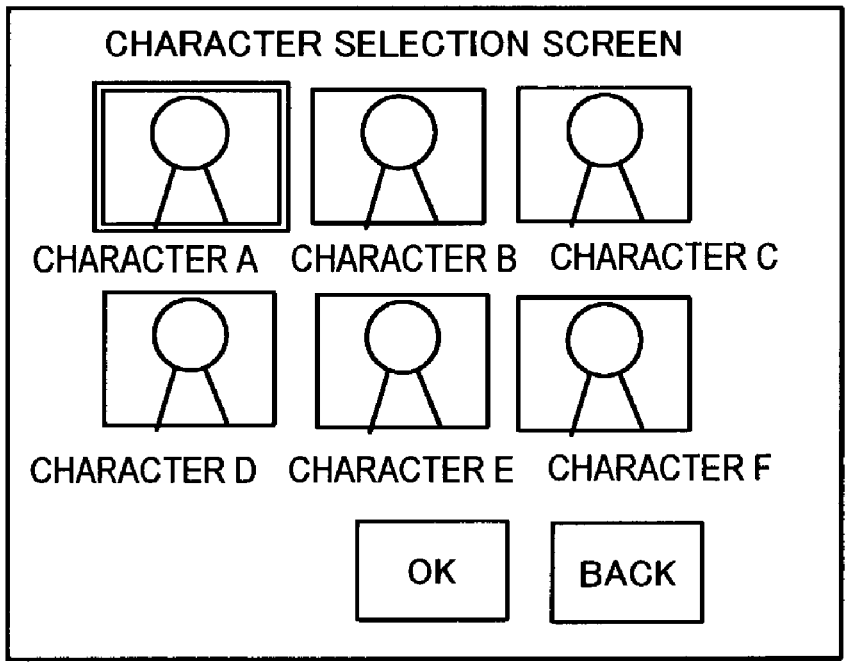
FIG. 5 shows an example of a character selection screen of the game apparatus.

FIG. 5 shows an example of a character selection screen from the game apparatus. In the game program, default values for each character's nickname, age, gender, height, weight and skin color etc. are registered. More precisely, the player may change the appearance of the chosen character. In other words, the game may make it possible for the player to create a new character that corresponds to the player's tastes from a character that is in the default state.

Figure 6:
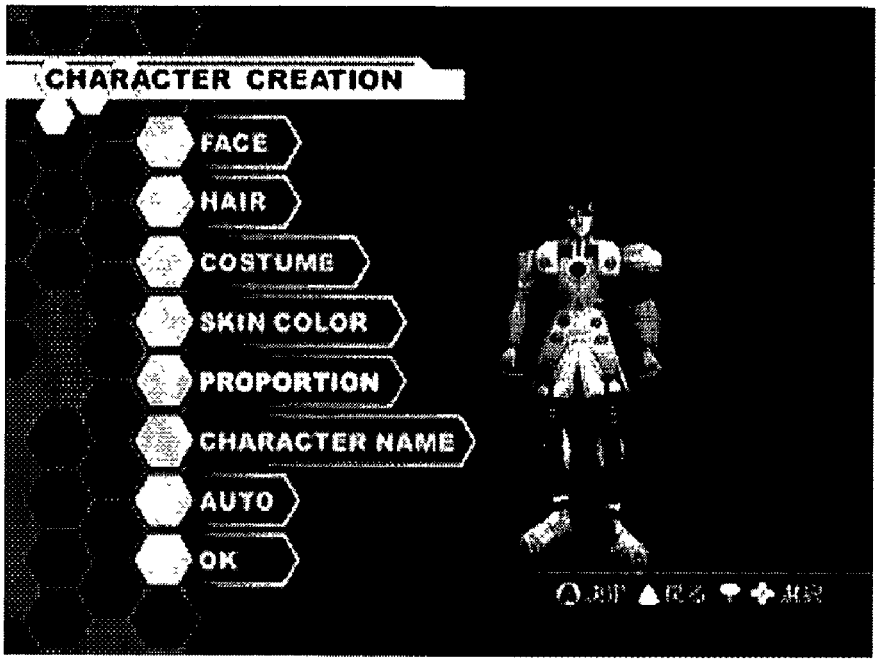
FIG. 6 shows an example of a character creation screen of the game apparatus.
Figure 7:
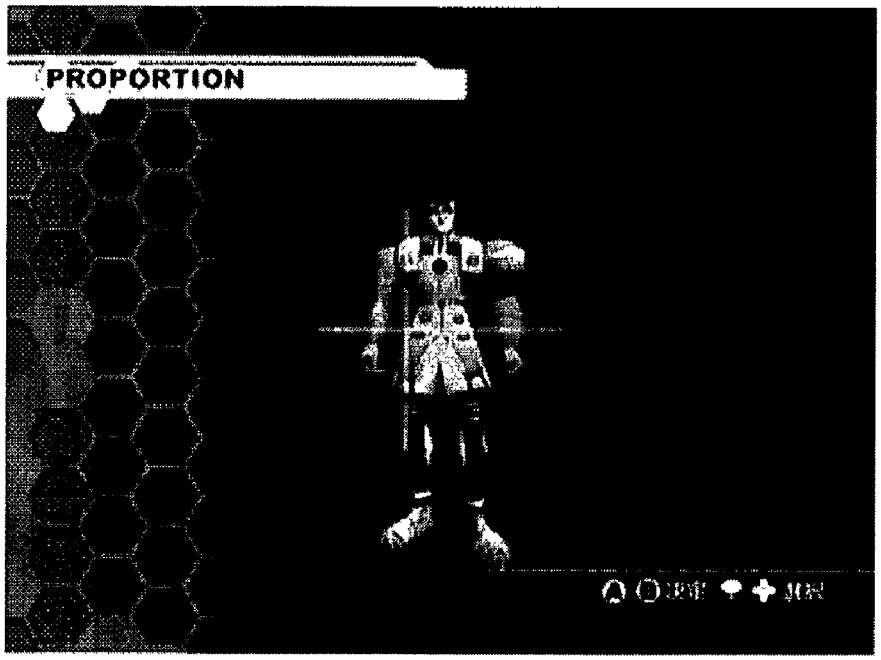
FIG. 7 shows an example of the character creation screen of the game apparatus.

FIGS. 6 to 10 show examples of character creation screens from the game apparatus. FIG. 6 shows a character creation menu screen. The screen of FIG. 6 shows a character in its default state. In addition, fields relating to the character's creation are displayed such as face (FACE), hair (HAIR), costume (costume), skin color (SKIN COLOR), proportions (PROPORTION) and character's name (CHARACTER NAME). For each field, one of the pre-prepared options can be selected. In the case of the character's name, this can be determined and entered directly by the player. In addition, regarding the character's proportions, these can be increased or decreased both vertically and horizontally according to the player's operations.

Figure 8:
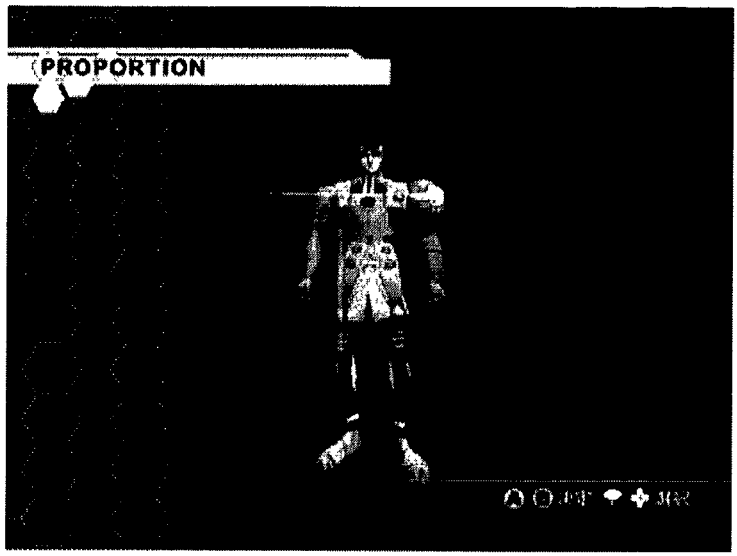
FIG. 8 shows an example of the character creation screen of the game apparatus.
Figure 9:
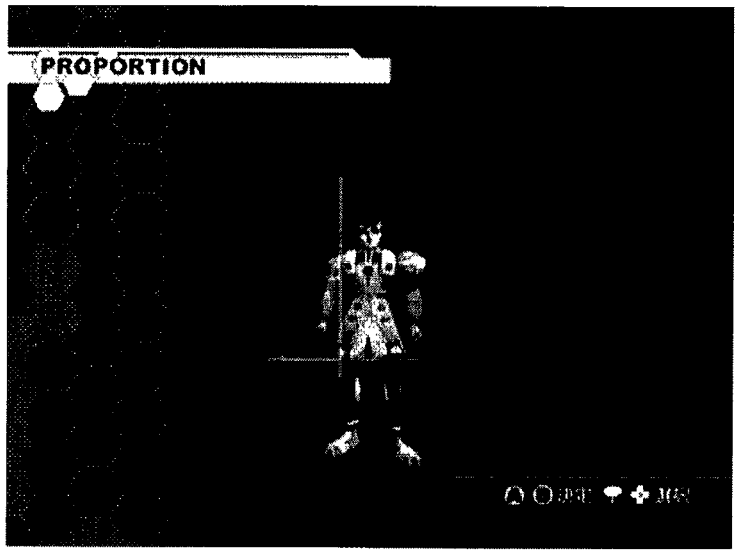
FIG. 9 shows an example of the character creation screen of the game apparatus.
Figure 10:
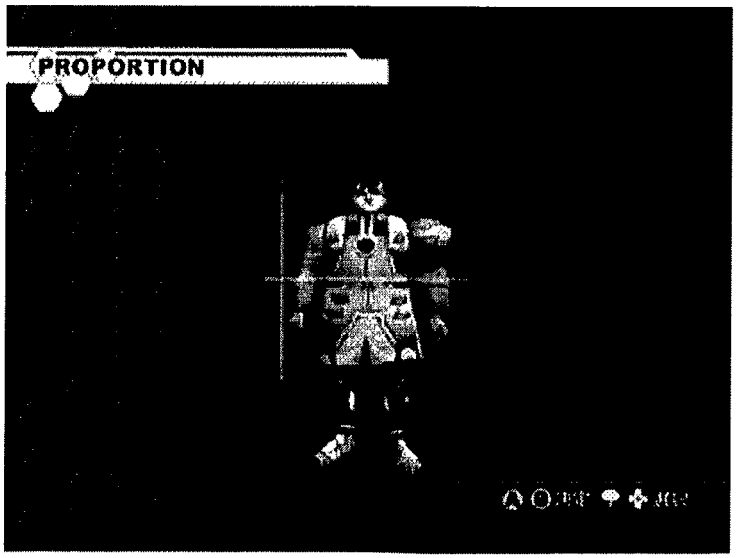
FIG. 10 shows an example of the character creation screen of the game apparatus.

FIGS. 7 to 10 show examples of the screen for setting character proportions. The character's height and body weight can also be set in relation to the default values of the character's proportions. By pressing the "UP" arrow key on the key-pad of the operations controller which is connected to the game apparatus, the player can increase the character's vertical proportions, as shown in FIG. 8. In other words the character's height is increased. Similarly, by pressing the "DOWN" arrow key, the character's vertical proportions can be reduced as shown in FIG. 9. In other words the character's height can be reduced. In addition, by pressing the "LEFT" arrow key, the character's horizontal proportions can be increased as shown in FIG. 10. In other words, the character can be made to grow fatter. Similarly, by pressing the "RIGHT" arrow key, the character's horizontal proportions can be reduced. In other words the character can be made to get thinner. By performing such operations the character's vertical and horizontal proportions are increased or reduced and the game program automatically recalculates the corresponding height and weight of the character.

In this way, the character's attribute information such as height and weight are created as the player selects the type and shape of his/her character.

In this way, when the character settings are made, the game program will create the parameters by which the player's voice will be converted, according to the attribute information of the character (S12). If the frequencies of a player's voice are analyzed, in general, the factors below can be considered to have an influence on the characteristics of the voice, and the frequencies that make up the player's voice can be changed in accordance with each of them.

(1) Gender

The frequencies that make up a female voice show a general shift towards high frequencies. The frequencies that make up a male voice shows a general shift towards low frequencies. Thus, when a male player selects a female character the overall range of frequencies is shifted towards higher frequencies and when a female player selects a male character, the overall range of frequencies is shifted towards lower frequencies.

(2) Age

With age the frequencies that make up the human voice show a gradual shift towards lower frequencies. Accordingly, if the player's age is lower than the age of the character, the overall range of frequencies is shifted towards lower frequencies in proportion to this age difference.

(3) Voice-breaking Period

The frequencies that make up the human voice before it breaks show a general shift towards higher frequencies. The frequencies of the human voice after it breaks show a general shift towards lower frequencies. It is possible to make an guess regarding the timing of the voice-breaking period based on gender and age to some extent. However it is also permissible to set this with no relation to either.

(4) Height

The level of obesity (described below) is set according to the relationship between this and body weight (indicated next) and thus the size of the shift in frequencies can be determined.

(5) Body Weight

There is a tendency for the volume of a voice to increase and the pitch to get lower in proportion to body weight. Accordingly, if the character's weight is more than the player's, the amplitude of the lower frequencies is increased in proportion to this weight difference. Likewise if the character is lighter than the player, the amplitude of the lower frequencies is reduced.

(6) Degree of Obesity

Degree of obesity is determined by the relative proportions of height to body weight. Since there is a tendency for the pitch of a voice to get lower as the degree of obesity increases (the fatter a person is) the whole range of frequencies is shifted towards lower frequencies. Therefore, if the character's level of obesity is higher than the player's, the range of frequencies is shifted towards the lower frequencies, and if the character's degree of obesity is lower than the player's then the range of frequencies is shifted towards the higher frequencies.

(7) Race/Species

When fictional humanoid characters are set in a game, a frequency conversion takes place in accordance with the type of race or species of the character. For example, if a bird-man appears in the game with a face like Ahiru (a mythic duck character) then in order to produce a high-pitched duck-like voice the whole range of frequencies is shifted towards the higher frequency range. In this case it is assumed that the player is a human being and so the size of the frequency shift and the size of the amplitude displacement are set in relation to the type of race or species of the character.

(8) Type

When characters are categorized by type such as brain-boxes, muscle-men, confident characters, and hesitant characters etc. in a game, the frequency changes are carried out in relation to that type. For example, the amplitude of the lower frequencies for a muscle-man character is increased (the volume of the voice is increased), and for a hesitant type of character the amplitude of the lower frequencies is reduced (the volume of the voice is diminished). In this case the size of the frequency shift and the size of the amplitude displacement is set in relation to the type of the character and not in relation to the type of the player. However, it is also possible to set the player's type from information fields input by the player and thus to determine the size of the frequency shift and the size of the amplitude displacement in relation to the difference between the two types.

An actual example of setting voice conversion parameters using body weight and the degree of obesity will then be described.

Figure 11:
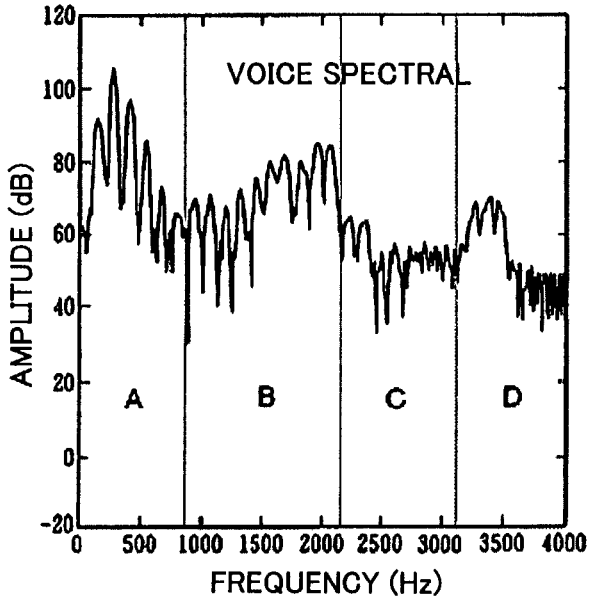
FIG. 11 shows an example of voice spectral data of the voice the player produces, analyzed by frequency.

FIG. 11 shows an example of the spectral voice data of the voice of a player that has been analyzed by frequency. Spectral data (voice data) such as that shown in FIG. 11 can be collected by the game apparatus by, for example, having the player read out loud a fixed phrase into the microphone apparatus before the game starts.

The game apparatus divides the collected voice data into frequency ranges (shown as ranges A, B, C and D in the figure). It then determines the multiplication factor for the amplitude of the frequencies of each range and additionally, once that is done, it determines the size of the shift of the whole spread of frequencies either towards higher frequencies or towards lower frequencies.

The voice conversion parameters, comprising variables according to which frequencies are altered (for example the scale factor by which the amplitude is increased or the shift size), can be set by the calculations of a prescribed function. Alternatively, a table could be prepared that contains amplitude multiplication factors and shift sizes specified in relation to the player's and character's information. By referring to such a table, the appropriate conversion values can be set by matching certain conditions.

For example, in step S10 the player's height of 160 cm and body weight of 55 Kg are registered as player information and in step S11 the created character has a height of 170 cm and body weight of 70 Kg. Since the character's weight is more than the player's, the lower frequencies of the player's voice will be emphasized. Similarly, as the character's degree of obesity is higher than the player's, the distribution of frequencies itself will be shifted towards lower frequencies.

By referring to the function or the table, the game program determines conversion factors such as the multiplication factor for the amplitude of the frequencies in proportion to the difference in body weight, and the size of the frequency shift in proportion to the obesity level. The conversion parameters are set, for example, as below.

Amplification scale factor for domain A: 1.05
Amplification scale factor for domain B: 1.03
Amplification scale factor for domain C: 1
Amplification scale factor for domain D: 1
Frequency shift value: −100 Hz In other words, the amplitude of the domain of lower frequencies will be increased, and also, the lower the domain of the frequencies the more they will be increased.

Figure 12A:
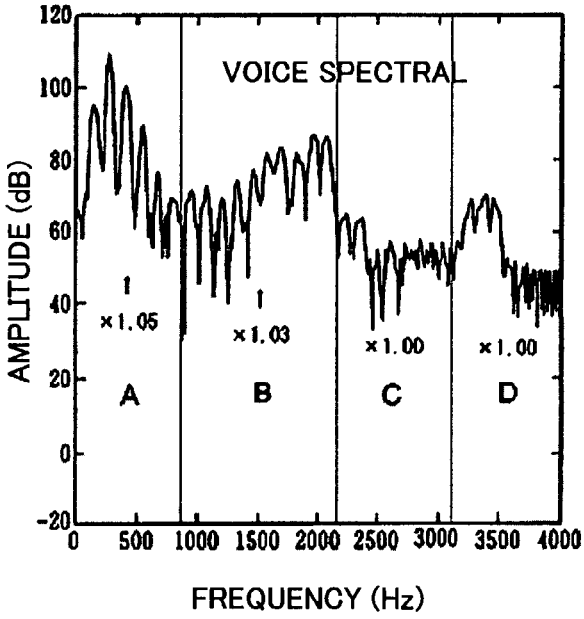
FIGS. 12A and 12B are explanatory diagrams of converted voice data.
Figure 12B:
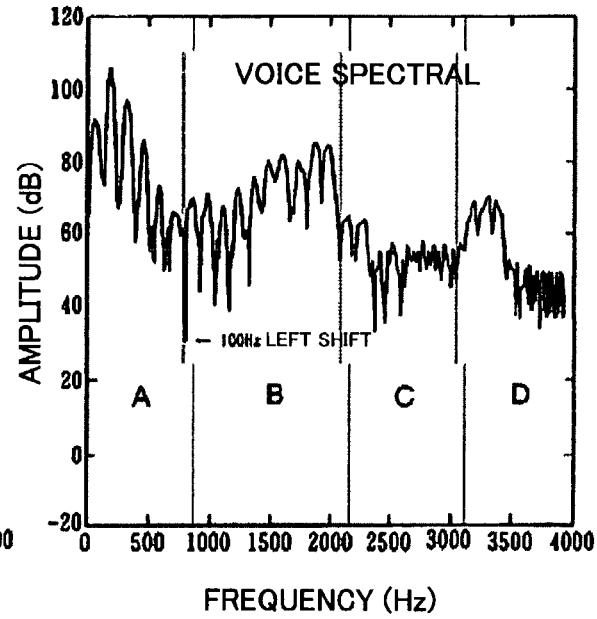
Figure 13:
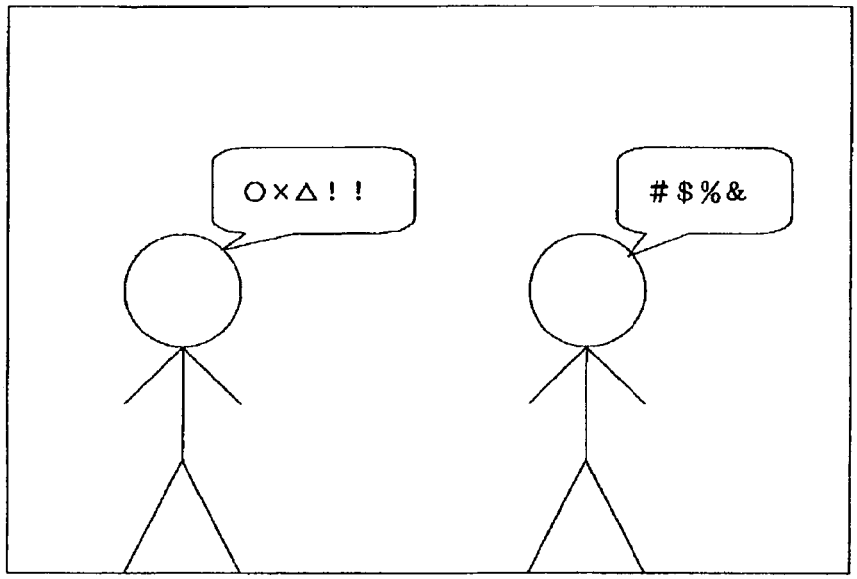
FIG. 13 (PRIOR ART)
FIG. 13 shows an example of a conventional game screen on which a speech balloon is displayed.

FIGS. 12A and 12B depict the converted voice data. FIG. 12A shows the spectral data of the frequencies of each of the frequency domains A, B, C and D, when multiplied by the above amplification scale factors. In addition, FIG. 12B shows the spectral data of the whole range of frequencies shifted according to the above shift value.

In FIG. 3, each of the game apparatuses is shown to be configuring the voice conversion parameters in relation to each player's voice and then starting the game once the information has been synchronized (S13). For example, while the game is in progress, when the voice of the player "a" is input into the game apparatus 10A (S14), the voice data is converted according to the conversion parameters (S15) and the converted voice data is sent to the other game apparatus 10B, as game data (S16). Then the game apparatus 10B outputs the converted voice data that it has received, as words spoken by the character of the other the player "a" (S17). In this way, rather than the voice itself of the player "a" being output, the voice output continues to reflect the voice of the player "a", but is also adapted according to the characteristics of the character. The game apparatus 10B, in the same way as the game apparatus 10A, converts the voice data of the player "b" according to the conversion parameters and sends the converted voice data to the game apparatus 10A. Then the game apparatus 10A outputs the converted voice data that it has received, as words spoken by the character of the player "b".

The voice control method of the above embodiment is particularly effective in games such as simulation games and role-play games (RPG) where a character representing the player's in himself/herself appears in the game. For example, if a character in a role-play game grows (his/her height and weight increases) or ages (age increases) as the game progresses, then by resetting the conversion parameters, and adopting the newly set conversion parameters, even if the character's characteristics change, its voice can be kept in step with these changes, and so a realistic game can be produced. Normally the progress of time in a game is much faster than that in the real world and so it is not necessary to consider the growth and aging of the player although, of course, there is nothing to stop this being considered.

In addition, although in the above embodiment, the conversion parameters for the player's voice data were set according to a comparison of factors that relate to the player's voice and factors that relate to the character's voice, in reverse it is possible to carry out a process to select or create the most suitable character according to the characteristics of the player's voice data. For example, the character, which is closest to the player in terms of gender, age, height and weight etc., could be selected or created. It is also permissible that the character's height and weight are capable of being adjusted to match the player's height and weight. In this case the player's voice may be output directly as the spoken words of the selected or created character.

In addition it is also permissible that the voice data to be converted according to the conversion parameters is not limited to being the voice produced by the player, but also could be, for example, voice data that is pre-prepared for each character and is then converted. For example, it is permissible that in the case of voice data being prepared for each character, the voice data corresponds to the default state of a character. If the height or weight are optionally changed, as described above, then conversion parameters will be created in relation to these changes and the voice data will be converted in relation to these values. It is also permissible that a range of voice data with no relation specified to any characters is prepared, and from these the voice data that is most appropriate, considering the characteristics of the chosen or created character, is selected.

Additionally, the above embodiment is not limited to network games and could also be applied to a game with at least one player that runs locally without using a network.

The protected scope of the present invention is not limited to the above embodiment but encompasses the invention detailed in the description of the scope of the patent application and inventions equivalent thereto.

The present invention, described above, allows for the voice produced by a character that appears in a computer game to be set in accordance with the character's characteristics and allows for the creation of various voices for each character set by each player. In particular, by converting the voice produced by the player in relation to the characteristics of the character and outputting the voice as that of the character, the player's voice can continue to be reflected in the game, while the voice is set to match the features of the character.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A voice control method for controlling a voice produced by a character appearing in a computer game, the method comprising:

a determination step for determining a body shape of the character according to operation of a player of the computer game;

a conversion step for converting a voice that is externally input or provided in advance, based upon attribute information concerning the body shape of the character; and an output step for outputting the converted voice as the voice of the character.

2. The voice control method according to claim 1, wherein the conversion step includes changing frequency characteristics of the voice that is externally input or provided in advance, based upon attribute information concerning the body shape of the character.

3. The voice control method according to claim 1, wherein the externally input voice is a voice produced by a player of the computer game.

4. The voice control method according to claim 3, wherein the conversion step includes obtaining a variation value in frequency characteristics of the voice produced by the player, based upon a relationship between attribute information concerning the body shape of the character and attribute information concerning the body shape of the player.

5. The voice control method according to claim 1, wherein the conversion step includes obtaining a variation value in frequency characteristics of the previously provided voice, based upon a change of attribute information concerning the body shape of the character.

6. The voice control method according to claim 1, wherein the attribute information concerning the body shape includes a height and a weight.

7. The voice control method according to claim 2, wherein the attribute information concerning the body shape includes a height and a weight.

8. The voice control method according to claim 3, wherein the attribute information concerning the body shape includes a height and a weight.

9. The voice control method according to claim 4, wherein the attribute information concerning the body shape includes a height and a weight.

10. The voice control method according to claim 5, wherein the attribute information concerning the body shape includes a height and a weight.

11. The voice control method according to claim 1, wherein a height and a weight of the character are obtained at the determination step.

12. The voice control method according to claim 2, wherein a height and a weight of the character are obtained at the determination step.

13. The voice control method according to claim 3, wherein a height and a weight of the character are obtained at the determination step.

14. The voice control method according to claim 4, wherein a height and a weight of the character are obtained at the determination step.

15. The voice control method according to claim 5, wherein a height and a weight of the character are obtained at the determination step.

16. A computer-readable record medium recording a computer program for controlling a voice produced by a character appearing in a computer game, the program comprising:

determination processing for determining a body shape of the character according to operation of a player of the computer game;

conversion processing for converting a voice that is externally input or provided in advance, based upon attribute information concerning the body shape of the character; and output processing for outputting the converted voice as the voice of the character.

17. The record medium according to claim 16, wherein the conversion processing includes changing frequency characteristics of the voice that is externally input or provided in advance, based upon attribute information concerning the body shape of the character.

18. The record medium according to claim 16, wherein the externally input voice is a voice produced by a player of the computer game.

19. The record medium according to claim 18, wherein the conversion processing includes obtaining a variation value in frequency characteristics of the voice produced by the player, based upon a relationship between attribute information concerning the body shape of the character and attribute information concerning the body shape of the player.

20. The record medium according to claim 16, wherein the conversion processing includes obtaining a variation value in frequency characteristics of the previously provided voice, based upon a change of attribute information concerning the body shape of the character.

21. The record medium according to claims 16, wherein the attribute information concerning the body shape includes a height and a weight.

22. The record medium according to claims 16, wherein a height and a weight of the character are obtained at the determination step.

23. A game apparatus which provides a control of a voice produced by a character appearing in a computer game, the apparatus comprising:

determination means for determining a body shape of the character according to operation of a player of the computer game;

conversion means for converting a voice that is externally input or provided in advance, based upon attribute information concerning the body shape of the character; and output means for outputting the converted voice as the voice of the character.

* * * * *